US012312894B2

(12) United States Patent
Melhus et al.

(10) Patent No.: US 12,312,894 B2
(45) Date of Patent: May 27, 2025

(54) METHOD FOR PULLING TUBULARS USING A PRESSURE WAVE

(71) Applicant: TCO AS, Indre Arna (NO)

(72) Inventors: Geir Arne Melhus, Bryne (NO); Jostein Elbert, Kjøpmannskjær (NO)

(73) Assignee: TCO AS, Indre Arna (NO)

( * ) Notice: Subject to any disclaimer, the term of this patent is extended or adjusted under 35 U.S.C. 154(b) by 0 days.

(21) Appl. No.: 17/602,364

(22) PCT Filed: Dec. 16, 2020

(86) PCT No.: PCT/NO2020/050316
§ 371 (c)(1),
(2) Date: Oct. 8, 2021

(87) PCT Pub. No.: WO2021/125971
PCT Pub. Date: Jun. 24, 2021

(65) Prior Publication Data

US 2022/0170337 A1 Jun. 2, 2022

(30) Foreign Application Priority Data

Dec. 20, 2019 (NO) ..... 20191518

(51) Int. Cl.
*E21B 31/16* (2006.01)
*E21B 29/00* (2006.01)
*E21B 43/116* (2006.01)

(52) U.S. Cl.
CPC ..... *E21B 31/16* (2013.01); *E21B 29/002* (2013.01); *E21B 43/116* (2013.01)

(58) Field of Classification Search
CPC ..... E21B 31/00–31/20; E21B 29/00; E21B 43/11
See application file for complete search history.

(56) References Cited

U.S. PATENT DOCUMENTS 1,927,310 A * 9/1933 Edwards ..... E21B 31/03 166/301
2005/0061506 A1* 3/2005 Grove ..... E21B 49/087 166/162

(Continued)

FOREIGN PATENT DOCUMENTS

GB 2515858 A 7/2016
WO 2013133718 A1 9/2013

(Continued)

OTHER PUBLICATIONS

Danish Patent and Trademark Office, 1st Technical Examination of your Patent Application for Danish app. No. PA 2022 00699; Issue date May 12, 2023.

*Primary Examiner* — Yanick A Akaragwe
(74) *Attorney, Agent, or Firm* — Flener IP & Business Law; Zareefa B. Flener

(57) ABSTRACT

A method for pulling a tubular out of a subterranean well including the steps of:

i) lowering a work string into the well which includes a perforating tool and a tubular pulling tool;
ii) connecting the tubular pulling tool to the tubular and apply a pulling tension to the tubular;
iii) activating the perforating while the applied pulling tension to the tubular is maintained;
iv) immediately upon activating the perforating tool and while maintaining pulling tension to the tubular, pulling the tubular on the work string out of the subterranean well;
wherein a cut in the tubular is formed prior to or simultaneously with step iii); and wherein the cut is arranged such that the tubular can be pulled out of the subterranean well during step iv).

Further, a system for pulling a tubular was also disclosed.

14 Claims, 6 Drawing Sheets

(56) References Cited

U.S. PATENT DOCUMENTS

| | | | | |
|---|---|---|---|---|
| 2012/0312549 | A1 | 12/2012 | Eddison | |
| 2015/0047845 | A1* | 2/2015 | Larsen | E21B 31/16 166/298 |
| 2019/0257168 | A1* | 8/2019 | Sunde | E21B 29/002 |
| 2020/0072009 | A1* | 3/2020 | Fairweather | E21B 29/005 |
| 2020/0408056 | A1* | 12/2020 | Burca | E21B 29/005 |

FOREIGN PATENT DOCUMENTS

| | | | |
|---|---|---|---|
| WO | 2015105427 | A2 | 7/2015 |
| WO | 2018203062 | A1 | 11/2018 |

* cited by examiner

METHOD FOR PULLING TUBULARS USING A PRESSURE WAVE

FIELD OF THE INVENTION

The invention relates to a method and a system for pulling tubulars from a subterranean well.

BACKGROUND OF THE INVENTION

The present invention relates to a method and a system for pulling tubulars from a subterranean well.

A hydrocarbon well undergoes completion once it has been drilled. Casing is tubing that is set inside the drilled well to protect and support the wellstream. In addition to providing stabilization and keeping the sides of the well from caving in on themselves, casing protects the wellstream from outside contaminants. Casing a well involves running steel pipe down the inside of a recently drilled well. The small space between the casing and the untreated sides of the well is filled with cement to permanently set the casing in place.

The casing is fabricated in sections, or joints, that are usually about 40 feet long (12 m) and screwed together to form longer lengths of casing, called casing strings. A well is drilled in stages to a certain depth, cased and cemented, and then drilled to a deeper depth, cased and cemented again, and so on. Each time the well is cased, a smaller diameter casing is used.

The widest type of casing is called conductor pipe, and it usually is about 30 to 42 inches in diameter for offshore wells and 16 inches in diameter for onshore wells. The next size in casing string is the surface casing, which can run several thousand feet in length. The last type of casing string that is run into the well, and therefore the smallest in diameter, is the production string or oil string. The production string is run directly into the producing reservoir.

When pulling a completion or abandoning a well the tubulars can be difficult to pull free due to solids that have settled in the annulus between the tubular to be pulled and the casing/tubular on the outside. With fine solids settled in the annulus there will be a relatively low permeability and pulling the tubular will result in a pressure drop along the surface of the tubular. The pressure drop will significantly increase the force needed to pull the tubing and added to the friction between the tubular and the settled solids the required pulling force might exceed the yield strength of the tubing or the pulling capability of the work string. The settled solids can origin from solids suspended in the mud or intentionally placed there.

WO 2013/133718 A1 teaches a method for removing casing from a well. The method includes setting a first sealing element into fluid-sealing engagement with the inside of the casing, lowering a flow-through string into the well, a cutting tool and a second, reversibly expandable sealing element being connected to the string, forming perforations into the casing by means of said cutting tool, expanding the second, expandable sealing element into fluid-sealing engagement with the inside of the casing, passing a pressurized fluid through the string and into the annulus via the perforations, so that the viscous and/or solid mass is displaced up the annulus, cutting the casing around its entire circumference; and pulling a length of the casing up from the well. The method utilizes expandable sealing element and passing a fluid at high pressure through the string into the annulus via perforations, so that the solids mass is displaced out of the annulus.

WO 2013/115655 A1 relates to a method and an apparatus for retrieving a tubing from a well at least partly filled with a liquid. The tubing having a first end portion and a second end portion. The method including the steps of (a) running a retrieval apparatus using a connecting means from a surface and into the well, the retrieval apparatus including: an engagement means for engaging the tubing; a sealing means for sealing a portion of the bore of the tubing; injection means for injecting a low density fluid into the tubing, (b) connecting the engagement means to a portion of the tubing; (c) activating the sealing means to close liquid communication in the bore of the tubing between the first end portion and the second end portion; (d) replacing at least a portion of a volume of liquid defined by the sealing means, the tubing and the second end portion of the tubing by a low density fluid introduced in said volume by the injection means; and (e) retrieving the tubing out of the well using the connecting means.

Pulling tubing in this scenario can result in recovery of only short sections of tubing and consequently many and time-consuming runs. There is therefore a need for an effective method for pulling tubulars from a subterranean well. It is an objective of the present invention to achieve this and to provide further advantages over the prior art. At least one of these aims is achieved by the device indicated in the enclosed independent claims. Other favorable or possible embodiments are indicated in the dependent claims.

WO 2015/105427 discloses a method for pulling casing pipes/liner in a petroleum well, comprising the steps of: a) perforating an actual section of said casing pipe in said well by means of a perforating gun, and then b) washing, by means of a washing tool in at least one casing pipe annulus outside the perforated section of said casing pipe for removing debris material, particles, cement or other bonding substances which otherwise hold said casing pipe section stuck, c) cutting, by means of a cutting tool said casing pipe within or below the perforated section for releasing it from the deeper residing, remaining portion of said casing pipe in said well, d) pulling said released, washed-out section of said casing pipe out of said well.

Using a wash tool as described above will necessitate enough space below the lowermost perforation to accommodate the perforating guns or any other components located below the wash tool in order to access the perforated section with the wash tool. An internal restriction below the area of interest might therefor limit the length of the perforation that can be achieved. Furthermore the washing by circulating fluids are often time consuming.

SUMMARY OF THE INVENTION

It is provided a method for pulling tubulars (2) out of a subterranean well (100), the method comprising the steps of:

i) lowering a work string (7) into the subterranean well (100), the work string (7) comprising a perforating tool (8) for perforating the tubular (2), and a tubular pulling tool (6) configured to engage and pull tubulars (2) out of the subterranean well;

ii) connecting the tubular pulling tool (6) to the tubular (2) and apply a pulling tension to the tubular (2);

iii) activating the perforating tool (8) to form plurality of perforations (10) extending from an inner wall of the tubular (2) through a material deposited in an annulus (3) defined between the tubular (2) and an outer tubular (1) while the applied pulling tension to the tubular (2) is maintained;

iv) immediately upon activating the perforating gun (8) continue pulling the work string (7) and the tubular to be removed out of the subterranean well (100)

In one embodiment, the work string further comprising a tubular cutting tool configured for circumferentially cutting the tubular. In one embodiment, after step ii), forming the tubular a cut with the tubular cutting tool.

In one embodiment, the pulling tool can be in the form of a down hole jacking tool.

In one embodiment, the work string further comprising a surge tool.

In one embodiment, the surge tool comprising a fluid chamber.

In one embodiment, the fluid chamber has an internal pressure lower than the pressure in the tubular. In one embodiment, the fluid chamber comprising gas.

In one embodiment, after step iii), activating the surge tool.

In one embodiment, the inner tubular is a production tubing. In one embodiment, the outer tubular is a casing.

In one embodiment, before step i), installing a seal a location below the tubular that is removed.

There is also provided a system for pulling tubulars in a subterranean well, the system comprising a perforating tool for perforating the tubular; a tubular pulling tool configured for pulling the tubular out of the subterranean, a cutting tool configured for forming a cut of the tubular, a surge tool comprising a fluid chamber with an internal pressure that is lower than the well pressure and the pressure in an annulus defined between the tubular and an outer tubular, wherein the perforating tool and the tubular pulling tool, the cutting tool and the surge tool are attached to a work string characterized in that the system not comprising a fluid circulation arrangement from the surface.

In one embodiment, the perforating tool comprising one or more perforating guns.

In one embodiment, the perforating tool is configured for forming the cut on the tubular.

In one embodiment, the inner tubular is a production tubing. In one embodiment, the outer tubular is a casing.

In an aspect, a method of pulling a tubular out of a subterranean well was disclosed including the steps of:

i) lowering a work string into the subterranean well, the work string including a perforating tool for perforating the tubular, and a tubular pulling tool configured to engage and pull tubulars out of the subterranean well;

ii) connecting the tubular pulling tool to the tubular and apply a pulling tension to the tubular;

iii) activating the perforating tool to form plurality of perforations extending from an inner wall of the tubular through a material deposited in an annulus defined between the tubular and an outer tubular while the applied pulling tension to the tubular is maintained;

iv) immediately upon activating the perforating tool and while maintaining pulling tension to the tubular, pulling the tubular on the work string out of the subterranean well;

wherein a cut in the tubular is formed prior to step iii) or simultaneously with step iii); and wherein the cut is arranged such that the tubular can be pulled out of the subterranean well during step iv).

There are a number of embodiments of this aspect. In an embodiment, the work string further includes a tubular cutting tool configured for forming the cut on the tubular. In an embodiment the perforating tool is configured for forming the cut on the tubular. In an embodiment the pulling tool is a down hole jacking tool. In an embodiment the work string further includes a surge tool. In an embodiment the surge tool includes a fluid chamber. In an embodiment the fluid chamber has an internal pressure lower than the pressure in the tubular. In an embodiment the fluid chamber includes a gas. In an embodiment in which after step iv), the step of activating the surge tool is performed. In an embodiment, before step i), the step of installing a seal area below the tubular that is removed is performed In another aspect, a system is disclosed to pull a tubular out of a subterranean well, including a work string including:

a perforating tool arranged to form a plurality of perforations through the tubular and into an annulus upon activation;

a tubular pulling tool configured pull a tubular out of the subterranean well by applying a pulling tension to the tubular;

a means to create a weakness in the tubular by forming a cut in the tubular;

wherein the tubular pulling tool is arranged to maintain tension on the tubular while the perforating tool activates.

In an embodiment of the aspect, the means to create a weakness in the tubular is a cutting tool or an arrangement on a portion of the perforation tool. An embodiment of the aspect includes a surge tool includes a fluid chamber with an internal pressure that is lower than the well pressure and the pressure in the annulus. In an embodiment of the aspect, the perforating tool includes one or more perforating guns. In an embodiment of the aspect, the cut is formed before or during the activation of the perforating tool

BRIEF DESCRIPTION OF THE DRAWINGS

These and other possible alternative or advantageous embodiments of the invention will become clear from the following detailed description of an embodiment, given as non-limiting examples, with reference to the attached schematic drawings, wherein.

DETAILED DESCRIPTION

Figure 1:
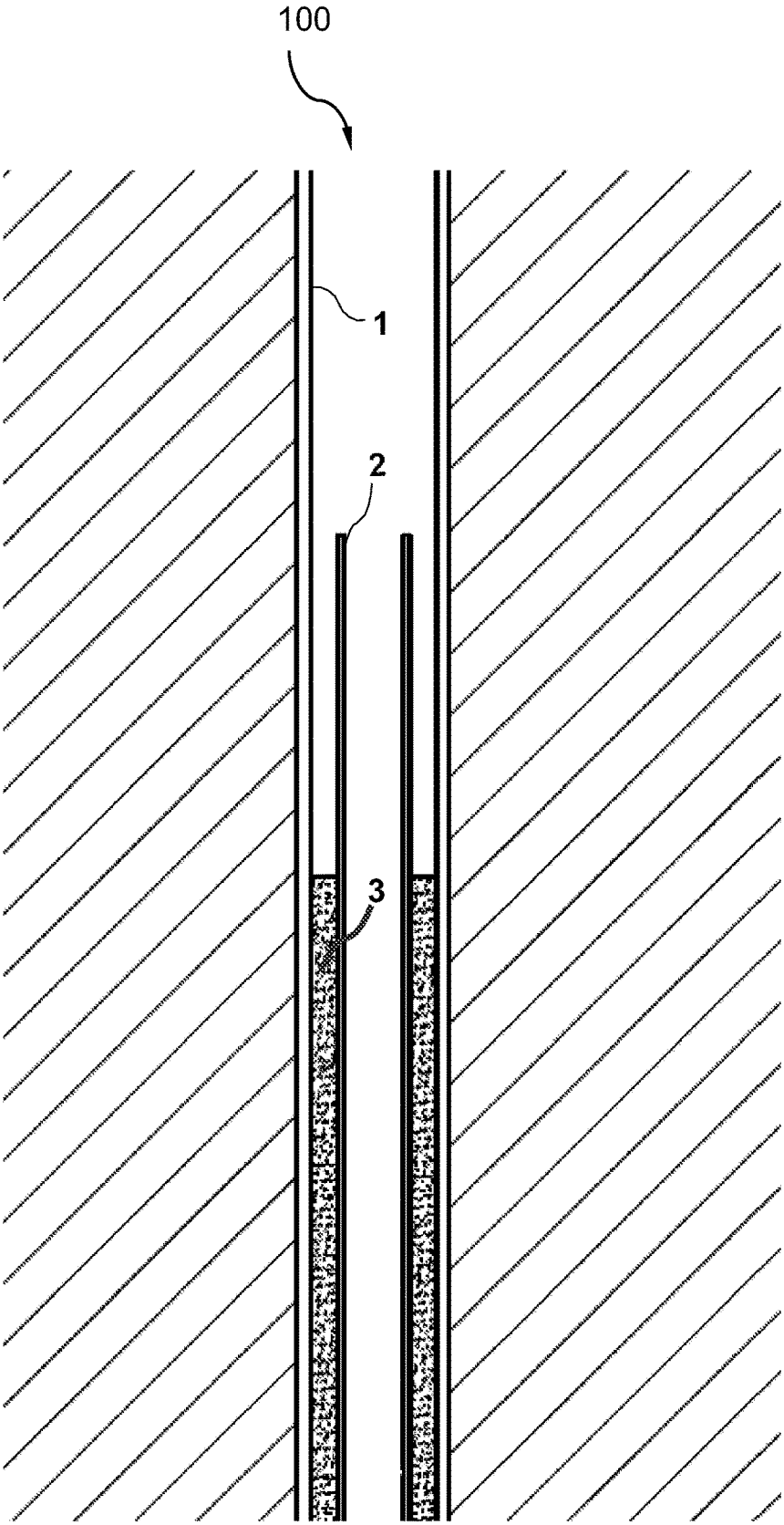
FIG. 1 shows a simplified cross section of a wellbore.

The following description may use terms such as "horizontal", "vertical", "lateral", "back and forth", "up and down", "upper", "lower", "inner", "outer", "forward", "rear", etc. These terms generally refer to the views and orientations as shown in the drawings and that are associated with normal use of the invention. The terms are used for the reader's convenience only and shall not be limiting.

FIG. 1 shows a simplified cross section of a wellbore 100 comprising several tubulars. In FIG. 1, it is shown an outer tubular 1 and an inner tubular 2 placed into the wellbore 100. The inner tubular 2 may be a production string. The outer tubular 2 may be a casing string. An annulus 3 between the outer tubular 1 and the inner tubular 2 may be filled with a material. The material 3 may be sand, barite, cement or other solids. The wellbore 100 may also include other components that are not shown in the figures.

Figure 2:
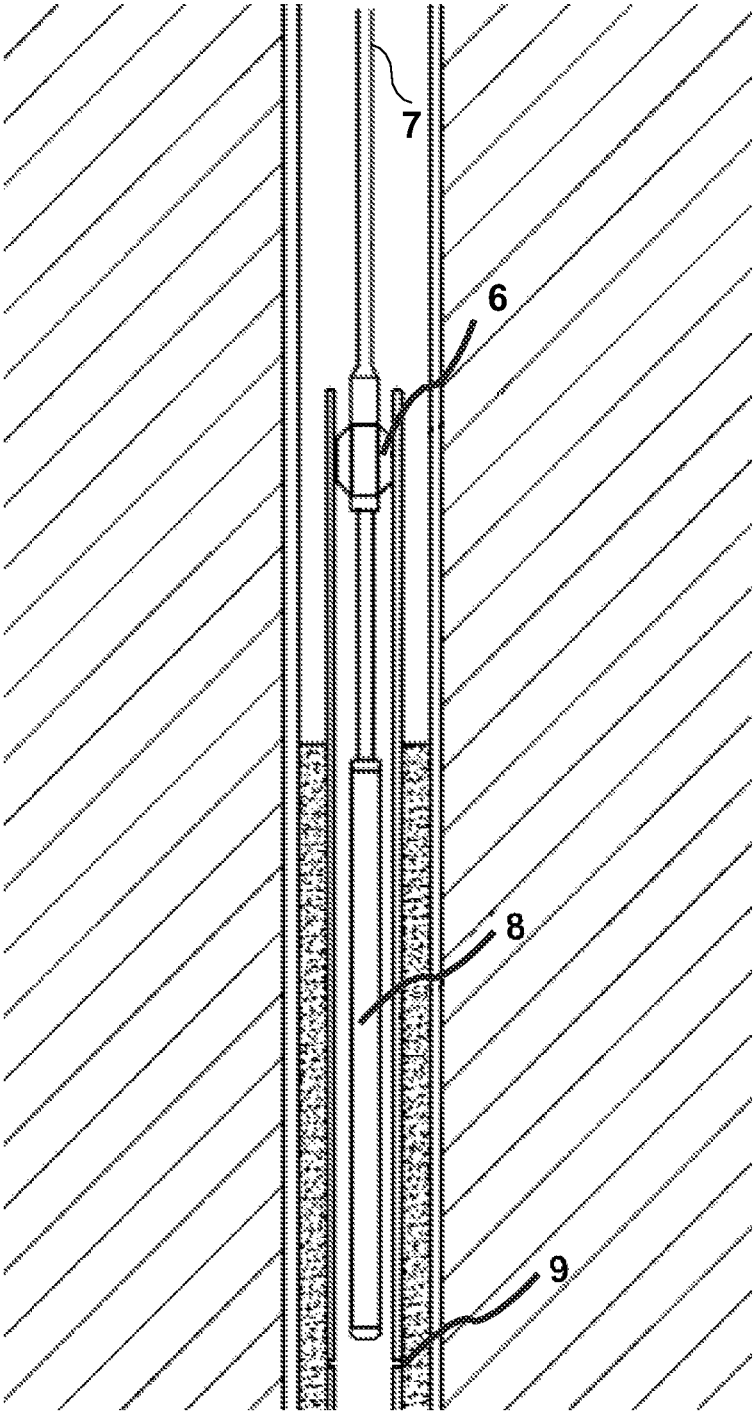
FIG. 2 shows the perforating tool and the tubular pulling tool according to the invention.

FIG. 2 shows the wellbore 100 where a perforating tool 8 and a tubular pulling tool 6 is lowered within the inner tubular 2 with a work string 7. The perforating tool 8 may comprise one or more perforating guns configured to punch small holes on the inner tubular 2. In some embodiments the outer tubular can also be perforated by the perforating gun. In some embodiments, the work string 7 may also include other components which are not shown in FIG. 2, for example a surge chamber and a tubular cutting tool.

The perforating tool 8 and the tubular pulling tool 6 may be lowered down in the tubular with a work string 7 to a predefined/desired depth. The tubular pulling tool 6 is connected to the tubular (2) and a pulling tension is maintained on the tubular. The tubular 2 may be cut around its circumference. The cut 9 may be formed in a separate run prior to lowering the work string (7) into the well (100). The cut 9 may be formed by a cutting tool which may be attached to or may be part of the perforating tool and may be formed upon or simultaneously with the perforations 10.

It is important to understand that "cut" does not have to go entirely through the section of tubular 2. The purpose of the cut 9 is to create enough weakness in the tubular 2 such that when that when pulling tension is maintained and the perforation guns activate, the tubular 2 can be pulled free from the well.

The amount of weakness that is formed in the tubular from the cut will be determined by several factors. Some examples of these factors include the thickness of the tubular wall, the material of the tubular, the angle of the cut, the age and strength of the cement, pressure on the tubular, amount of force that the pulling tool can apply. The calculation of these factors and establishment of how much weakness is enough is well within the ability of one skilled in the art.

The cut 9 can be formed with a cutting tool that cuts entirely through the wall of the tubular 2 around the circumference of the pipe. But it can also be formed with by the cutting tool cutting partway through the tubular 2 wall. Another option is to form the cuts at intervals around the circumference of the tubular 2 (either all the way or part of the way through). It can also be formed by an arrangement of charges on the perforation gun itself or as another tool on the same work string. The arrangement could produce the cut 9 entirely around the circumference of the tubular 2 or by creating enough holes in the tubular 2 wall that the tubular 2 can be pulled out during operation. It can be easier to form a cut 9 simultaneously with the activation of the perforating tool 8 by using an arrangement of charges, rather than a cutting tool.

A combination of cutting tool and charges can be used to create the required weakness formed by the cut. The cut can also be at an angle with respect to the longitudinal axis of the tubular.

Both a cutting tool and an arrangement of charges are examples of a means to create a weakness in a tubular. Normally it is at the cut where the separation of the tubular 2 to be pulled from the rest of the entire length of pipe within the well will occur. However, these can be some arrangements, where the separation will occur in the neighboring region of the cut, but not precisely on it. For example, the perforating tool forming the cut can be two or more rows of perforations around the circumference at different heights within the tubular 2. The separation could occur between the rows, rather than on a single specific row. Another example could be that more than one cut is made by the cutting tool.

While the figures show that the cut 9 is formed in the tubular 2 before the operation of activation of the perforation gun, this is not the case. It is possible for the cut to be formed at the same time as the activation of the perforation gun. This has the advantage of the entire operation being possible in a single run. If the cut is made by the cutting tool, on the same work string as the perforation gun, it will normally be arranged below the perforation gun. However, it is possible for the cutting tool to be arranged above the perforation gun depending on how the work string is going to be operated.

Figure 3:
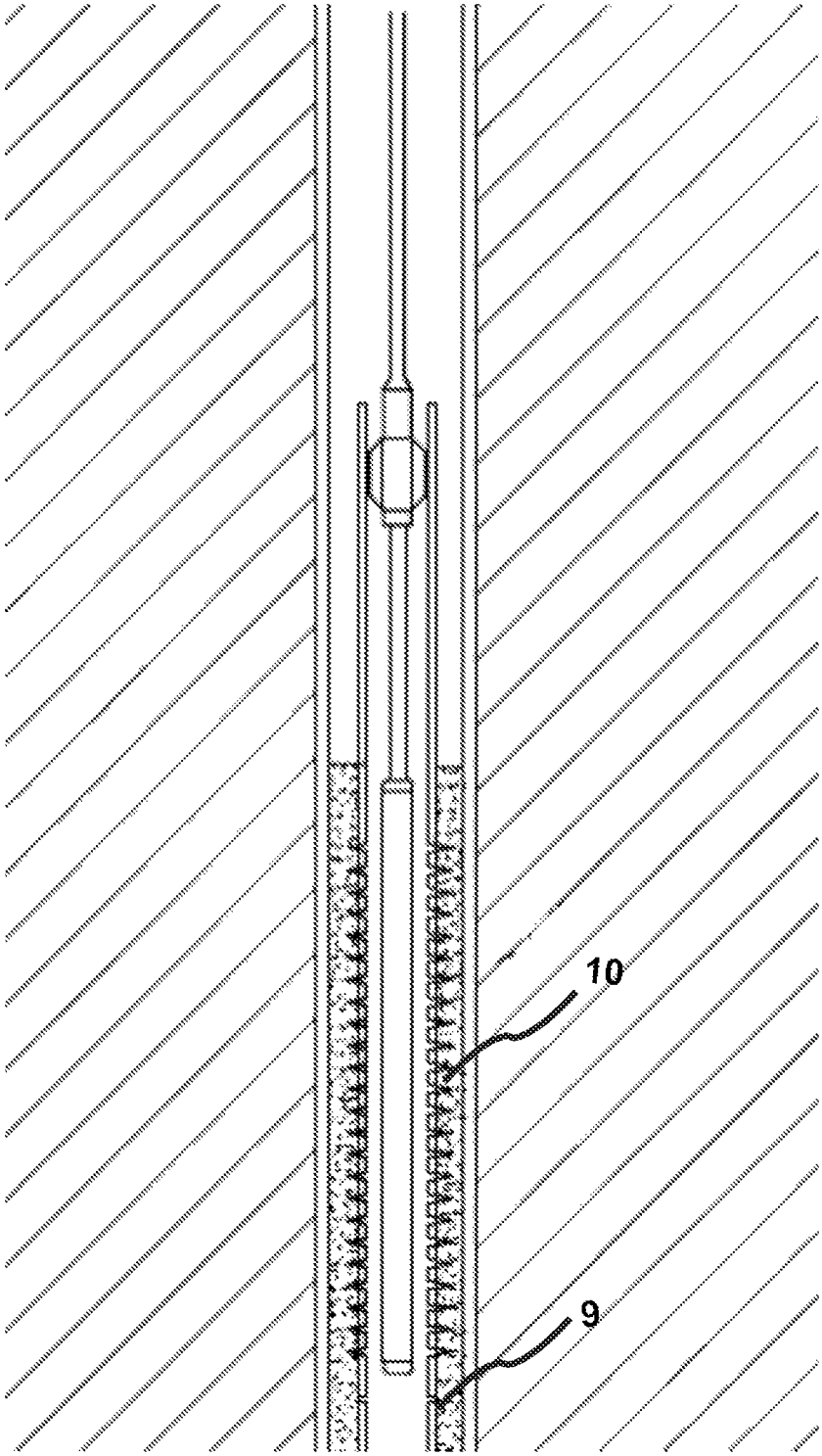
FIG. 3 shows perforation of the tubular according to the invention.

After the perforating tool 8 and the tubular pulling tool 6 is lowered down in the tubular 2, tubular pulling tool 6 is activated so that it attaches to the tubular (2) and a pulling tension is introduced to the tubular 2. Due to the friction force between the outer surface of the tubular 2 and the material in the anulus (3) the tubular (2) is prevented from moving, FIG. 3 shows that a substantial length of the tubular 2 is perforated forming perforations 10. The tubular to be removed may be perforated along its entire length if needed. A plurality of perforations 10 are formed simultaneously while the tubular (2) is in tension from the pulling tool 6. By perforating the tubular 2, the friction along the outer surface of the tubular 2 is reduced in the area around the perforations 10. Furthermore, the pressure wave from the perforation guns can break up the settled solids in the area around the perforations 10 and increase the permeability. With the sudden reduction of friction, increase of permeability and pressure wave from the perforating event the tension from the pulling tool will be able to move the tubular (2). This eliminates the need for displacing solid mass with a pressurized fluid through the tubular 2 via perforations 10. This may eliminate the application of drilling rig during tubular pulling operations, since there is no fluid circulation needed. The present disclosure may be carried out in a wireline operation whereby a wireline carries the tubular pulling tool 6, the perforating tool 8 and other components in the same trip into the well. This has a considerable cost savings for the operators compared with drilling rigs. The present disclosure enables pulling the tubular 2 in one run. This may be achieved by forming the cut 9 with a cutting tool that may be part of the perforating tool 8 or which may be a separate unit attached to the perforating tool 8. In alternative embodiment, the cut 9 may also be formed simultaneously with the perforations 10. The perforations may be extending from the inner wall of the tubular 2.

Figure 4:
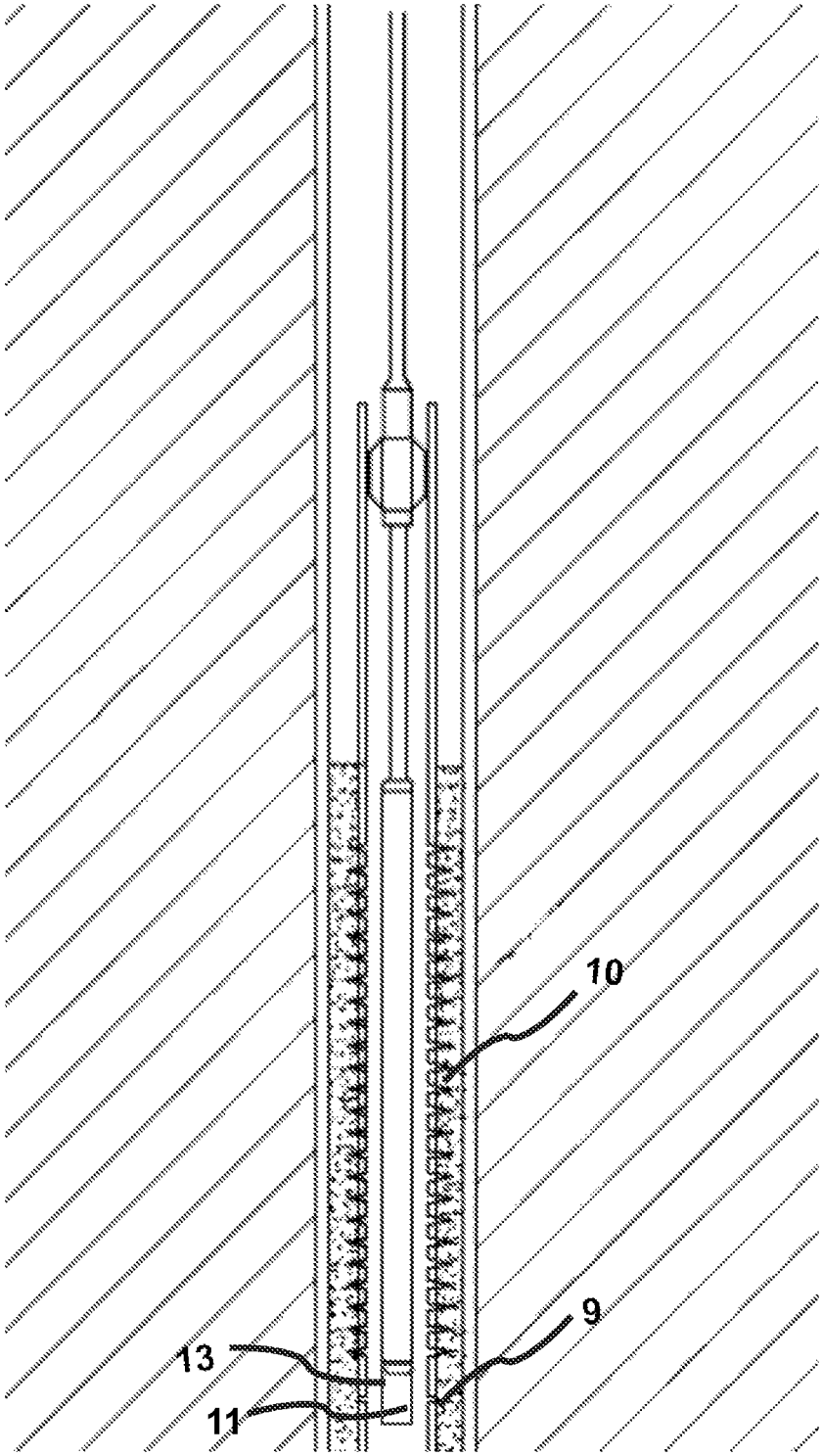
FIG. 4 shows an alternative embodiment of the invention.

In an alternative embodiment, dynamic under balance is introduced. By introducing dynamic under balance when perforating the settled solids in the annulus 3 may be broken up further and reduce the friction even further. FIG. 4 illustrates a surge tool 13 located below the perforating tool, and operating the surge tool may comprise flowing fluid and solids from the annulus 3 into the fluid chamber 11. The fluid chamber 11 may be filled with gaseous fluid prior to running tools into the well. The fluid chamber 11 may be provided with an internal pressure being lower than the well pressure in the tubular 2 to be removed and the annulus 3. Thereby, liquids or other fluids present in the annulus 3 may flow into the fluid chamber 11 when the fluid chamber 11 is operated. By providing a sufficiently low pressure in the fluid chamber 11, for example approximately atmospheric pressure, a rapid flow of fluid into the fluid chamber 11, when operated, may be achieved, thereby breaking up the settled solids in the annulus and further reduce the required pulling force without fluid circulation from the surface. The dynamic under balance may be introduced simultaneously with the perforations 10. Immediately upon activating the perforating gun (8), after perforating the tubular 2, the pressure drop along the outer surface of the tubular 2 is reduced in the area around the perforations 10.

Figure 5:
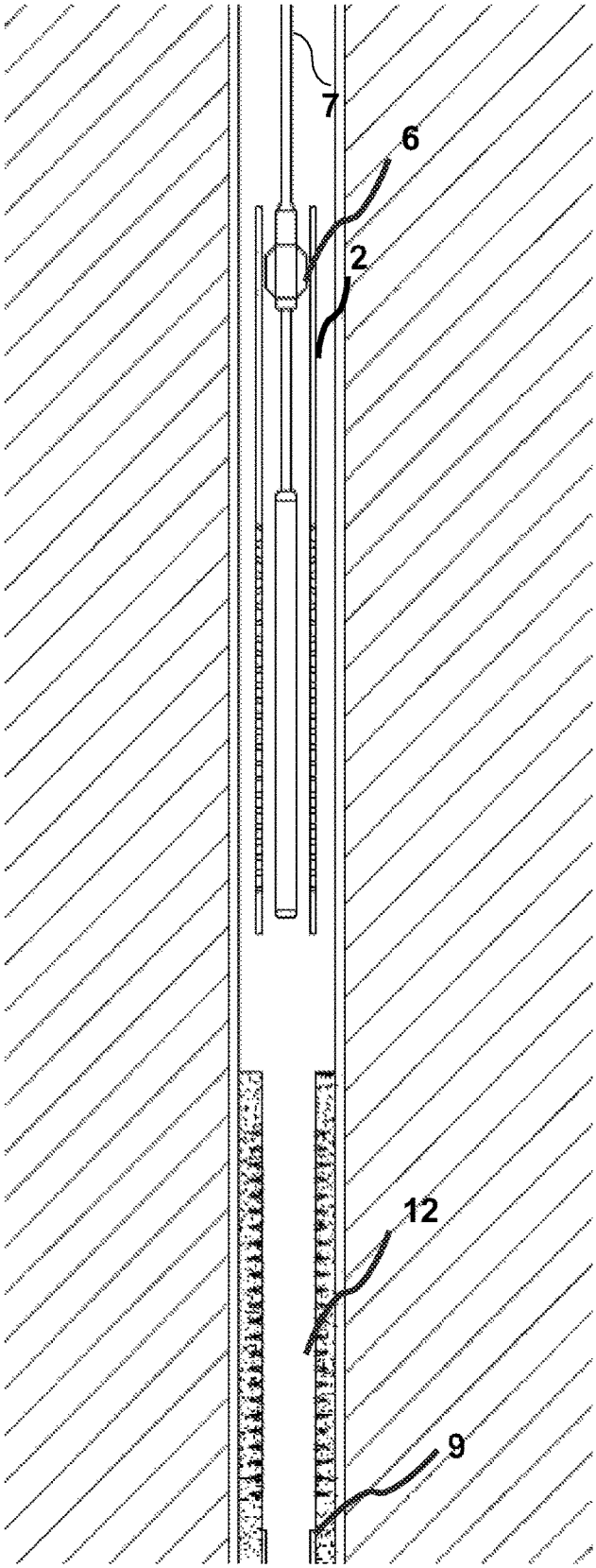
FIG. 5 shows lifting of the tubular according to the invention.

FIG. 5 discloses pulling the tubular 2 from its location 12 with the tubular pulling tool 6 which is attached to the work string 7. The entire perforated tubular 2 may be lifted in one run. In alternative embodiments, a temporary seal (not shown) may be set below the cut 9 in order to prevent fluid flow from the area blow the cut 9. The seal may be installed before lowering the perforating tool 8 and the tubular pulling tool 6 in the well. Alternatively, the seal may be attached to the work string 7 and lowered to the well simultaneously with the perforating tool and tubular pulling tool.

Figure 6:
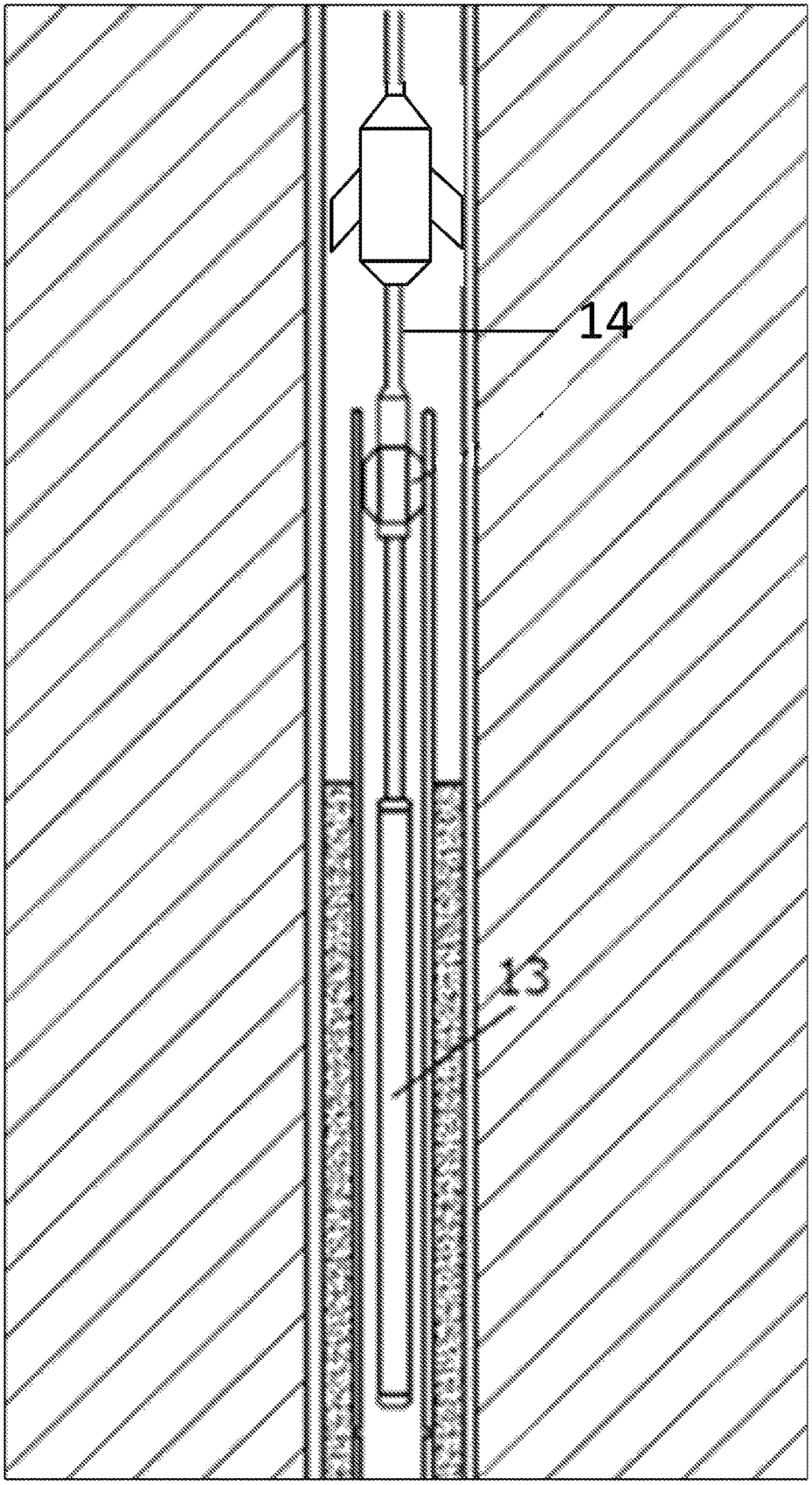
FIG. 6 shows an alternative embodiment of the invention with a down hole jack.

FIG. 6 shows an alternative to FIG. 2. If the pulling capacity of the rig is limited the pulling tool can be combined with a down hole jack 14. The down hole jack 14 is placed in the work string above the pulling tool and when on depth, it anchors to the outer tubular. A hydraulic cylinder between the anchor and the pulling tool is operated to create a high pulling force on the pulling tool and keep the inner tubular in tension when activating the perforating tool/gun.

The present disclosure in some embodiments provides a method for pulling tubulars out of a subterranean well, the method comprising the steps of: i) lowering a work string into the subterranean well, the work string comprising a perforating tool for perforating the tubular, and a tubular pulling tool configured to engage with the inside of and pull tubulars out of the subterranean well; ii) connecting the tubular pulling tool to the tubular; iii) activating the perforating tool to form plurality of perforations extending from an inner wall of the tubular through a material deposited in an annulus defined between the tubular and an outer tubular; iv) immediately upon activating the perforating gun and while maintaining pulling tension to the tubular, ripping the tubular on the work string out of the subterranean well without fluid circulation from the surface.

An embodiment of the present disclosure is a method wherein the work string further comprising a tubular cutting tool configured for circumferentially cutting the tubular. An embodiment of the present disclosure is a method wherein the work string further comprising a surge tool comprising a fluid chamber. An embodiment of the present disclosure, after step ii), forming the tubular a cut with the tubular cutting tool. An embodiment of the present disclosure is a method wherein the inner tubular is a production tubing and the outer tubular is a casing. An embodiment of the present disclosure is a method wherein, before step i), installing a seal a location below the tubular that is removed without fluid circulation from the surface.

Another embodiment of the present disclosure is a system for pulling tubulars in a subterranean well, the system comprising a perforating tool for perforating the tubular; a tubular pulling tool configured for pulling the tubular out of the subterranean, a cutting tool configured for forming a cut of the tubular, a surge tool comprising a fluid chamber with an internal pressure that is lower than the well pressure and the pressure in an annulus defined between the tubular and an outer tubular, wherein the perforating tool and the tubular pulling tool, the cutting tool and the surge tool are attached to a work string characterized in that the system not comprising a fluid circulation arrangement from the surface.

An embodiment of the present disclosure, the surge tool is comprising a fluid chamber.

An embodiment of the present disclosure, the perforating tool is comprising one or more perforating guns. An embodiment of the present disclosure, the perforating tool is configured for forming the cut on the tubular. An embodiment of the present disclosure, the inner tubular is a production tubing. An embodiment of the present disclosure, the outer tubular is a casing.

While it is an advantage that a tubular can be pulled without fluid circulation from the surface into the annulus, there could be situations where this could be advantageous. It may be possible that a tubular is difficult to pull and the fluid circulation will make this easier.

While the present disclosure has been described with reference to the embodiment illustrated, it should be understood that modifications and/or additions can be made to the device, which remain within the field and scope of the invention.

The invention claimed is:

1. A method for pulling a tubular (2) out of a subterranean well (100), the method comprising the steps of:

i) lowering a work string (7) into the subterranean well (100), the work string (7) comprising a perforating tool (8) for perforating the tubular (2), and a tubular pulling tool (6) configured to engage and pull tubulars (2) out of the subterranean well;

ii) connecting the tubular pulling tool (6) to the tubular (2) and apply a pulling tension to the tubular (2);

iii) activating the perforating tool (8) to form a plurality of perforations (10) extending from an inner wall of the tubular (2) through a material deposited in an annulus (3) defined between the tubular (2) and an outer tubular (1) while the applied pulling tension to the tubular (2) is maintained;

iv) immediately upon activating the perforating tool (8) and while maintaining pulling tension to the tubular (2), pulling the tubular (2) on the work string (7) out of the subterranean well (100); and cutting the tubular (2) using a cutting tool to form a cut (9) prior to step iii) or simultaneously with step iii); and wherein the cut (9) is arranged such that the tubular (2) can be pulled out of the subterranean well (100) during step iv).

2. The method according to claim 1, wherein the perforating tool is configured to cut the tubular (2).

3. The method according to claim 2, wherein the tubular pulling tool (6) is a down hole jacking tool (14).

4. The method according to claim 1, wherein the pulling tool is a down hole jacking tool (14).

5. The method according to claim 1, wherein the work string (7) further comprises a surge tool (13).

6. The method according to claim 5, wherein the surge tool (13) comprises a fluid chamber (11).

7. The method according to claim 6, wherein the fluid chamber (11) has an internal pressure lower than the pressure in the tubular (2).

8. The method according to claim 6, wherein the fluid chamber (11) comprises a gas.

9. The method according to claim 6, wherein after step iv), activating the surge tool (13).

10. The method according to claim 1, wherein the pulling tool is a down hole jacking tool (14).

11. A system to pull a tubular (2) out of a subterranean well (100), comprising a work string (7) comprising:

a perforating tool (8) arranged to form a plurality of perforations (10) through the tubular (2) and into an annulus (3) upon activation; and a tubular pulling tool (6) configured to pull the tubular (2) out of the subterranean well by applying a pulling tension to the tubular (2);

a cutting tool configured to create a weakness in the tubular (2) by forming a cut (9) in the tubular (2), wherein the cut (9) is formed before or during the activation of the perforating tool (8); and wherein the tubular pulling tool (6) is arranged to maintain tension on the tubular (2) and move the tubular (2) upwards when the perforating tool (8) activates.

12. The system of claim 11, further comprising a surge tool (13) comprising a fluid chamber with an internal pressure that is lower than the well pressure and the pressure in the annulus (3).

13. The system according to claim 11, wherein the perforating tool (8) comprising one or more perforating guns.

14. The system of claim 11, wherein the cutting tool is an arrangement on a portion of the perforation tool (8).

* * * * *